US011653742B2

(12) United States Patent
Bickford et al.

(10) Patent No.: US 11,653,742 B2
(45) Date of Patent: May 23, 2023

(54) BEAUTY TOOL

(71) Applicant: L'OREAL, Paris (FR)

(72) Inventors: William Bickford, Scotch Plains, NJ (US); Karin Kaskiel, New York, NY (US); Lemis Tarajano, Brooklyn, NY (US)

(73) Assignee: L'Oreal, Paris (FR)

( * ) Notice: Subject to any disclaimer, the term of this patent is extended or adjusted under 35 U.S.C. 154(b) by 261 days.

(21) Appl. No.: 16/206,870

(22) Filed: Nov. 30, 2018

(65) Prior Publication Data

US 2020/0170379 A1 Jun. 4, 2020

(51) Int. Cl.

| | |
|---|---|
| ***A45D 33/34*** | (2006.01) |
| ***A45D 40/28*** | (2006.01) |
| *A45D 34/04* | (2006.01) |

(52) U.S. Cl.

CPC ..... *A45D 40/28* (2013.01); *A45D 34/04* (2013.01); *A45D 2200/1018* (2013.01)

(58) Field of Classification Search

CPC .... A45D 2200/1009; A45D 2200/1018; A45D 2200/1027; A45D 2200/1036; A45D 40/30; A45D 2200/1045; A45D 33/005; A45D 33/34; A47K 7/02; A47K 7/022; A47K 7/024; A47K 7/028

See application file for complete search history.

(56) References Cited

U.S. PATENT DOCUMENTS

| | | | | | |
|---|---|---|---|---|---|
| 1,439,734 | A * | 12/1922 | Guinzburg | A45D 33/34 | 15/229.14 |
| 3,226,761 | A * | 1/1966 | Adamsky | B44D 3/12 | 401/266 |
| 3,955,233 | A * | 5/1976 | Nakamura | A45D 33/34 | 132/320 |
| 4,698,871 | A * | 10/1987 | Patkos | A45D 33/34 | 15/118 |
| 5,490,302 | A * | 2/1996 | Dion | A47K 7/022 | 15/210.1 |
| 5,628,083 | A * | 5/1997 | Hayes | A47K 7/024 | 15/210.1 |
| 5,913,318 | A * | 6/1999 | Gueret | A45D 33/34 | 132/293 |
| 2002/0155281 | A1* | 10/2002 | Lang | A61Q 19/00 | 428/337 |
| 2003/0014824 | A1* | 1/2003 | Farmer | A47K 7/02 | 15/118 |
| 2003/0123919 | A1* | 7/2003 | Gueret | A45D 34/00 | 401/130 |
| 2004/0011377 | A1* | 1/2004 | Michel | A45D 33/005 | 132/320 |

(Continued)

OTHER PUBLICATIONS

Non-Final Rejection for U.S. Appl. No. 16/206,853, dated Aug. 28, 2020, 10 pages.

*Primary Examiner* — Cris L. Rodriguez
*Assistant Examiner* — Brianne E Kalach
(74) *Attorney, Agent, or Firm* — Christensen O'Connor Johnson Kindness PLLC

(57) ABSTRACT

A beauty tool may include a cover made from a fishnet material. A beauty tool may include a cover made from a material configured for cleansing, exfoliation, and/or massaging a keratinous material without damaging the keratinous material and a body defining a hollow interior received within the cover.

18 Claims, 1 Drawing Sheet

(56) References Cited

U.S. PATENT DOCUMENTS

| | | | | |
|---|---|---|---|---|
| 2004/0116017 | A1* | 6/2004 | Smith, III | B32B 7/05 442/123 |
| 2004/0247373 | A1* | 12/2004 | Gueret | A45D 34/04 401/123 |
| 2006/0099026 | A1* | 5/2006 | Griffon | A45D 37/00 401/266 |
| 2006/0141014 | A1* | 6/2006 | Eknoian | A45D 40/00 424/443 |
| 2006/0171997 | A1* | 8/2006 | Gruenbacher | A47K 7/03 424/443 |
| 2007/0277844 | A1* | 12/2007 | Gueret | A45D 34/04 132/320 |
| 2009/0180826 | A1* | 7/2009 | Guay | A45D 34/04 401/197 |
| 2013/0131575 | A1 | 5/2013 | Dacey, Jr. et al. | |
| 2015/0088162 | A1* | 3/2015 | Chapin | A45D 44/22 606/131 |
| 2016/0213221 | A1* | 7/2016 | Krause | C08J 9/0004 |
| 2016/0235650 | A1* | 8/2016 | Simard | A61Q 3/02 |
| 2018/0338600 | A1* | 11/2018 | Dizes | B32B 27/20 |
| 2018/0360194 | A1* | 12/2018 | Cho | A45D 34/04 |
| 2019/0059548 | A1 | 2/2019 | Chaillet-Piquand et al. | |
| 2019/0159572 | A1 | 5/2019 | Tarajano | |
| 2020/0170377 | A1 | 6/2020 | Tarajano et al. | |

* cited by examiner

BEAUTY TOOL

SUMMARY

In one embodiment, a beauty tool may include a cover made from a fishnet material. The fishnet material may be polyester, nylon, or any combination thereof.

The cover may include at least first and second sides and at least first, second, and third corners.

The cover may include at least a first area coated with a first material and second area coated with a second material different from the first material. The first area of the cover may include at least one of a hydrophilic material or a hydrophobic material. The hydrophilic material may be chosen from a group consisting of polyvinylpyrolidone (PVP), polyurethanes, polyacrylic acid (PAA), polyethylene oxide (PEO), polysaccharides, and any combination thereof. The hydrophobic material may be chosen from a group consisting of manganese oxide polystyrene (MnO2/PS) nano-composite, zinc oxide polystyrene (ZnO/PS) nano-composite, precipitated calcium carbonate[3], carbon nanotube structures, silica nano-coating, and any combination thereof. The first area of the cover may include a hydrophilic material and the second area may include a hydrophobic material. At least a portion of the cover may be treated with a plasma treatment. At least a portion of the cover may have a patterned surface to increase wettability.

The beauty tool may further include a body defining a hollow interior received within the cover. The hollow interior of the body may be configured to be pressurized. At least one of the material of the cover and a cross-sectional thickness of the body may at least partially determine the rigidity of the tool.

One or more surfaces or areas of the cover may be defined by a first material in a warp direction and a second material in a weft direction. One or more areas of the cover may include material threads having at least one of varying thicknesses and cross sectional shapes. One or more areas of the cover may be made from a material having shape memory characteristics. One or more areas of the cover may be made from a restructuring or reconfiguring material, such as a self-healing polymer.

In another embodiment, a beauty tool may include a cover made from a material configured for cleansing, exfoliation, and/or massaging a keratinous material without damaging the keratinous material and a body defining a hollow interior received within the cover. In such an embodiment, the hollow interior of the body may be configured to be pressurized. In such an embodiment, the cover may be made from a fishnet material. The fishnet material may be made from polyester, nylon, or any combination thereof. The cover and/or the body may include at least a first area coated with a first material and second area coated with a second material different from the first material. The first area may include at least one of a hydrophilic material or a hydrophobic material.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Cosmetic formulations are often removed from or applied to a person's face, hair, skin, nails, etc. ("keratinous materials"), with a tool, such as a brush, sponge, blender, bristle, cloth, wipe, towel, etc., or with formulation, such as oil, miscellar water, multiphase solutions, etc. The configuration will depend on the intended end use. For instance, cosmetic formulas removed from the skin, such as the face, may be removed with a sponge, cloth, wipe, etc.

The sponge, cloth, wipe, etc., is not typically shaped to appropriately conform to every contour of the face or another area of the body. For instance, a sponge may be an overall oval shape with flat sides. Although such a shape may be appropriate for removing a formulation from large areas of the face, the rounded edges may not be small enough to reach into more contoured areas of the face, such as under the eyes or nose. A wipe or a cloth may more easily conform to the contours of a user's face for effective removal of the cosmetic formulation; however, the wipe is not reusable, and the cloth takes significant time to clean and dry. Moreover, the cloth or wipe may not be suitable for exfoliating the keratinous material.

A sponge, cloth, puff, etc., may also have a fixed density, firmness, etc., that is suitable for one area of the face, but not another area. For instance, a denser, firmer sponge may be used to remove cosmetic formulation from all areas of the face except the eye area, which requires a softer, more delicate cleansing. As a result, multiple different tools must be used to remove cosmetic formulations from different areas of the face or similar areas of the body.

A sponge, cloth, blender, puff, etc., may also have a density, firmness, etc., that does not provide adequate sensorial effects during use. For instance, a denser, firmer sponge, a silicone blender, or the like may be too firm to provide a fingertip-like sensation to the user during removal or application of a cosmetic formulation. Such tools are also often difficult to hold and/or manipulate against a keratinous material. As a result, a user may result to using his/her fingertips, which does not typically provide a desired cleansing, exfoliation, or cosmetic result.

Thus, an improved tool that can be adapted for use on various parts of a user's face, body, hair, nails, etc., and/or that can be adapted for various uses (thorough removal, massaging, and/or cleansing of a cosmetic formulation, exfoliation, etc.), and/or that provides improved sensorial effects is desired. Such an improved tool would beneficially be easy to clean or otherwise hygienic to use.

Figure 1:
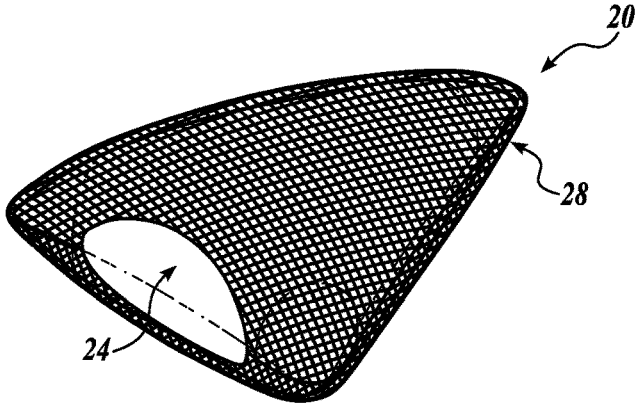
FIG. 1 is an isometric view of a beauty tool formed in accordance with an exemplary embodiment of the present disclosure.
Figure 2:
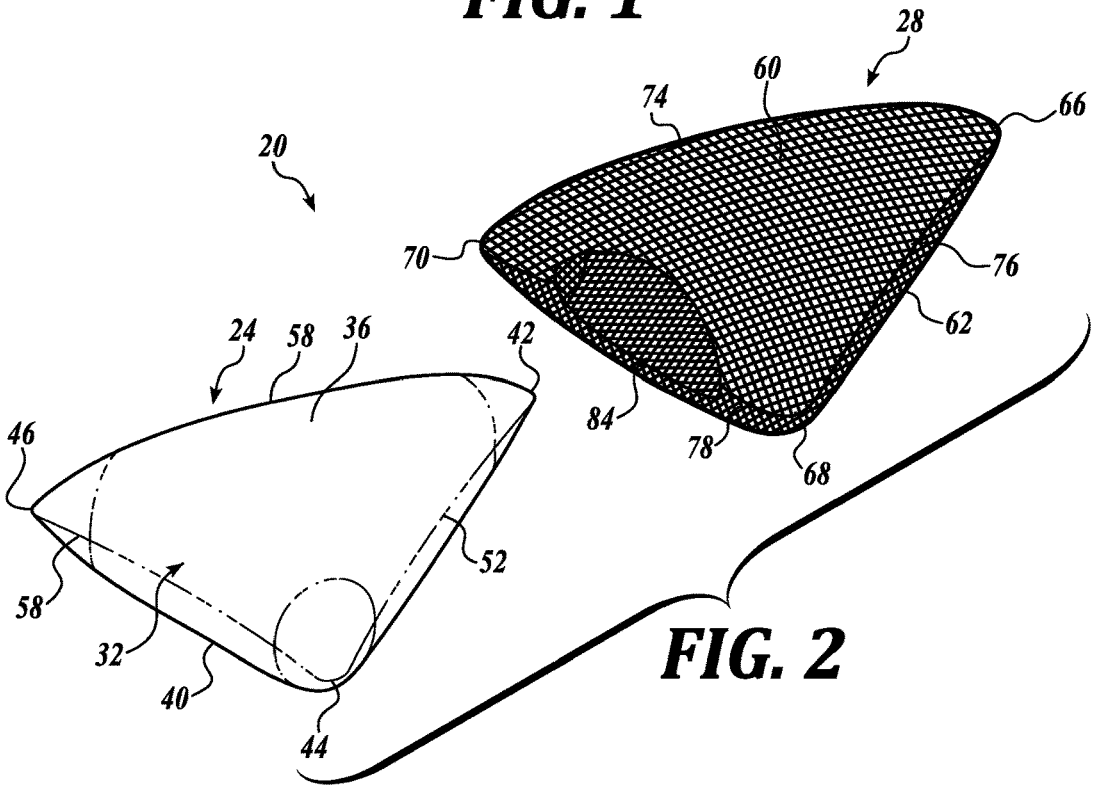
FIG. 2 is an exploded isometric view of the beauty tool of FIG. 1.
Figure 3:
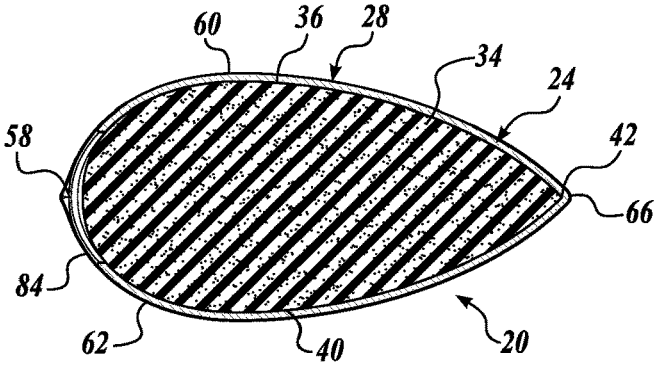
FIG. 3 is a cross sectional view of the beauty tool of FIG. 1.

Referring to FIGS. 1-3, a first exemplary embodiment of a beauty tool 20 will now be described in detail. The beauty tool 20 is of a suitable shape, size, firmness, material, etc., for effectively and hygienically removing, cleansing, exfoliating, and/or massaging, etc., (hereinafter sometimes referred to as "keratinous treatment(s)") the face, skin, nails, hair, etc. ("keratinous materials") while providing desired sensorial effects, and while being easy to clean.

In one embodiment, the beauty tool 20 includes a body 24 enveloped or enclosed by a removable, washable, and/or disposable cover 28. The body 24 may be any suitable configuration, such as a solid piece of foam or other material, a hollow, unpressurized molded piece, similar to that shown and described in U.S. patent application Ser. No. 15/828,046, which is hereby expressly incorporated by reference herein in its entirety, or any other type of interior component or structure. In the exemplary embodiment depicted in FIGS. 1-3, the body 24 is configured as a hollow, pressurized core, substantially similar to that shown and described in U.S. patent application Ser. No. 15/693,312, which is hereby expressly incorporated by reference herein in its entirety.

In that regard, the body 24 is made from a suitably deformable and/or expandable material that defines at least one interior compartment 34 that can be inflated or deflated as desired, like a bag, pillow, or cushion. For instance, the body 24 may be made from a material such as plastic (such as a suitable polymer), rubber, fabric, etc., such that when air or another gas, fluid, liquid, semi-solid, or solid is injected into the interior compartment 34 of the body 24, the volume of the interior compartment 34 is increased or decreased as needed to adjust the firmness, size, shape, etc., of the body 24. In that regard, the body 24 may include a suitable opening and/or valve (not shown) for inflating and deflating or otherwise filling/emptying the body 24.

The vacuum contained within the interior compartment 34 allows a precisely controlled deformation of the body 24 to fit to the relief and the hollows of the continuous surface of the skin or other surface. For instance, the adjusted and appropriate pressure allows the body 24 (sides, edges, corners, etc.) to fit to any face anatomy or desired area of the body. In one embodiment, the pressure is in between about 15-30 psi. By having the ability to add or remove air, gas, liquid, semi-solid, solid, etc., from the interior compartment 34 (with the valve, for instance), the user may adjust the interior pressure of the body 24 according to his/her needs and therefore have, with only one applicator, several functions depending on the pressure that is chosen/selected.

The body 24 may be at least partially filled with any suitable material (gas, liquid, semi-solid, solid, etc.) for providing a remover 20 of a desired firmness, resiliency, malleability, sensorial effect, etc., for the intended application. For instance, in some embodiments, the body 24 may be filled with a gas, such as ambient air, to provide a light-weight, resilient remover 20. In other embodiments, the body 24 may be filled with a liquid, such as water, to provide a heavier remover 20. In yet other embodiments, the body 24 may be filled with a denser material, such as oil, to make the applicator more firm such that it is more precise for contouring products, concealers, or other products that require precision. In yet other embodiments, the body 24 may be filled with foam or a similar material to provide a semi-dense, lightweight, malleable remover 20. It should be appreciated that the material used to at least partially fill the body 24 may be adjusted in viscosity and other physical and chemical properties to adjust the firmness, resiliency, malleability, sensorial effect, etc., for the intended application. Moreover, in alternate embodiments, the body 24 may have multiple interior compartments, with each configured to be filled with a different material and/or with a different pressure. In such alternative embodiments, the remover 20 would include areas of varying firmness, resiliency, malleability, sensorial effect, etc., for various applications with a single applicator.

As noted above, the body 24 may be made from a suitably deformable and inflatable material such as plastic (such as a suitable polymer), rubber, fabric, etc. The material may be any suitable thickness (such as between about 0.1 mm and 2 mm) in one or more areas of the body 24 to provide a more firm (with a thicker material) or less firm (with a thinner material) body 24. As a specific example, the material may be thinner in the larger areas of the body 24 and thicker in the smaller areas of the body, such as in corners or more pointed areas. As yet another example, a first side of the body 24 may have a first thickness and an opposite side of the body 24 may have a second thickness.

The material of the body 24 may be either transparent, translucent, opaque, foiled or metallized, patterned, etc., in whole or part, and/or coated at least partially with a transparent, translucent, or opaque material or film. For instance, in some embodiments, the body 24 will be transparent such that when the interior compartment 34 is filled, it can be easily seen by the user. In other embodiments, the body 24 is a certain translucent or transparent material having a designated color for corresponding to an intended application. In yet other embodiments, certain portions of the body 24, such as the corners, are of a certain translucency and/or color to indicate a target area for application. The body 24 may also be made from and/or coated with a suitably waterproof material such that it may be easily cleaned and reused for various applications and such that cosmetic formulation transfer may be substantially prevented.

One or more surfaces or areas of the body 24 may also include patterned areas, grooves, surface bumps, protrusions, textures, areas of changing color, etc., to aid in the removal or application of a cosmetic formulation, to indicate an intended area of use for a specific application, and/or to provide an aesthetically pleasing remover 20. The texture may be created by cutting or defining a pattern in the outer surface of the body 24, by changing the type of material, with flocking, coating, molding, etc.

In that regard, the body 24 may also be coated with, treated with, or otherwise formed with a suitable material to increase the removal, cleansing, exfoliation, and massaging effects or keratinous treatments, increase/decrease absorption of cosmetic formulation, enhance sensorial effects, reduce cleaning/drying time, etc. For instance, a textured surface of the body 24 (in combination with the cover 28) may aid in keratinous treatments with or without certain types of cosmetic formulations, whereas a lower coefficient of friction on the outer surface of the body 24 (in combination with the cover 28) may provide a smoother surface for a more gentle keratinous treatment on more sensitive areas (such as the eyes and lips).

In some embodiments, the body 24 may be laminated with a suitable foam or other material. For instance, the body 24 may be laminated with a composite material known by the name of PolyDry™, available from Creative Foam Medical Systems of Bremen, Ind. As a specific example, the composite material may be applied by thermopressure welding.

The material or outer surface of the body 24 may also vary in surface roughness/texture, shape, coefficient of friction, etc., in different areas of the body. For instance, in an alternative embodiment, the body may include one or more outer surface areas having flocked material, ridges, or another type of textured surface. Moreover, in alternative embodiments having multiple interior compartments, the outer surface of the body may have different areas of varying texture, coefficient of friction, etc., to correspond to a uniquely pressurized interior compartment. For instance, a softer interior compartment may include a more textured surface to provide suitable abrasion of a surface, whereas a firmer body 24 may have a smoother surface for a less abrasive application. It should be appreciated that any suitable combination of materials, features or configurations may be used.

The body 24 is also suitably shaped for the intended application. For instance, the body 24 may be suitably shaped for keratinous treatments on both a large surface area, such as the cheeks and forehead of the face, as well as a more targeted area, such as under the eyes, nose, and the chin of the face. In the exemplary embodiment depicted in FIGS. 1-3, the body 24 is generally a flattened conical shape or a pillow-like triangular shape having first and second opposing convex sides 36 and 40, and first, second, and third corners 42, 44, and 46. The first and second sides 36 and 40 are connected by rounded, continuous edges such that the beauty tool 20 has an overall generally flattened conical shape or a pillow-like triangular shape, as noted. Any other suitable pillow-like shape, such as a square, oval, polygonal, etc., may instead be used.

The beauty tool 20 may be formed as a single integral piece to avoid any sharp or abrupt edges. However, in some embodiments, the remover 20 may be formed as two pieces generally defined by the first and second sides 36 and 40 that are sealed along their first and second lateral edges to define an overall pillow shaped body. The flattened conical/pillow-like triangular shape of the beauty tool 20 is optimized for keratinous treatments on precise, targeted areas while at the same time being suitable for keratinous treatments on a larger area. More specifically, the corners 42, 44, and 46 (and optionally the lateral edges) of the pillow-shaped body 24, and the areas of the opposing sides 36 and 40 near the corners and edges are suitable for keratinous treatments on a more contoured or narrow area, such as around the eyes, nose, chin, etc. At the same time, the larger surface area of the first and second opposing sides 36 and 40 (and optionally the exterior surface of any plug, as described below) define a larger application area for keratinous treatments on a larger surface area, such as the cheeks and forehead of the face.

In other embodiments, the body may include specially shaped portions for targeted keratinous treatments, such as cone-shaped areas, pointed areas, etc. Thus, it can be appreciated that the contoured shape of the body 24 can precisely fit within the edges, contours, hollows, etc., of a user's body with suitable sensorial effects to allow gentle and precise keratinous treatments on the skin, hair, scalp, nails, etc. A suitable handle, tab, etc. (not shown), solid or flexible, may extend from the body 24 for gripping and using the body 24 during application. The body 24 could also be configured to be attached to one or more different types of handles depending on the end use.

Although the exemplary embodiment of the beauty tool 20 is shown as a flattened conical/pillow-like triangular shape, the beauty tool may instead have a body of any suitable shape or geometry. For instance, in alternative embodiments, the beauty tool may have a body that is square, oval, or cylindrical, or any other suitable regular or irregular shape. The shape may be depend on the type of keratinous treatments (i.e., removal, cleansing, exfoliation, massaging, etc.) and/or the area on which it is being applied (i.e., face, nails, lips, eyes, etc.)

The removable, washable, and/or disposable cover 28 for receiving and covering the body 24 will now be described in detail. The cover 28 is configured to be used with or without the body 24 for keratinous treatments. In one embodiment, the cover is configured to effectively remove cosmetic formulations from keratinous materials, massage cosmetic formulations on keratinous materials, exfoliate keratinous materials, etc., without damaging the keratinous materials.

In the depicted exemplary embodiment shown in FIGS. 1-3, the cover 28 is configured to envelope or enclose the body 24 in a manner such that the cover 28 substantially and tightly conforms to the shape of the body 24 to precisely fit (together with the body 24) within the edges, contours, hollows, etc., of a user's body with suitable relief to allow gentle and precise treatment of a keratinous material.

In that regard, the cover 28 is substantially triangular, having first and second opposing sides 60 and 62 and first, second, and third corners 66, 68, and 70. The first and second sides 60 and 62 are sealed along first, second, and third edges 74, 76, and 78 to define an overall pillow shaped beauty tool 20 (when received on the body 24) having soft edges. With the cover 28 substantially conforming to the shape of the body 24, the beauty tool 20 will allow the user to adjust the expected cleansing, exfoliation, and/or make-up application result. Of course, the cover 28 may instead be any other suitable shape to conform to any suitably-shaped body.

In addition to or in lieu of a tightly conforming fit, the interior surface of the cover 28 may be temporarily or permanently glued to or otherwise attached to the outer surface of the body 24 to minimize any shifting, bunching, or movement of the cover 28 relative to the body 24 during use. In that regard, the outer surface of the body 24 and/or the interior surface of the cover 28 may include one or more adhesive portions that are initially covered by a releasable backing that may be removed prior to use. In an alternative embodiment, the outer surface of the body 24 and/or the interior surface of the cover 28 may be coated with a tacky or other high-friction material to minimize movement of the cover 28 relative to the body 24.

The cover 28 further includes an opening through which the body 24 may be inserted for disposing the cover 28 on the body 24 (and through which any handle, tab, etc., extending from the body 24 may protrude). Any suitable opening may be used, such as an elastic opening 84 defined along a portion of the lower edge 76 that may be stretched over the body 24. In the alternative, the opening 84 may be defined by a non-elastic opening that is enclosable by a hook and loop fastener (Velcro®), a zipper, or another suitable enclosure mechanism. The opening allows the cover 28 to be removable from the body 24 and replaceable with a clean or different cover. In this manner, various different covers 28 may be used with a single body 24, and/or various different bodies 24 may be used with a single cover 28. In other words, the cover or body may be changed depending on the intended application or desired sensorial effect. For instance, the customizable cover/body combination will allow for the tool 20 to be used for various different applications.

In that regard, the cover 28 may be made from any suitable material having a suitable porosity, density, durometer, firmness, thickness, etc., for the desired application and effect. In the depicted exemplary embodiment, the cover 28 is made from polyester, nylon, or another suitable material that can be made into a fishnet and that aids in exfoliating, cleansing, or removing dirt, makeup, or other debris from the skin or other surface or massaging the skin or other surface without damaging the skin or other surface. For make-up removal, the cover 28 may be used with the appropriate make-up remover formula to allow for a gentle removal of the cosmetic formulation previously applied (liquid or powder types). In such a configuration, the cosmetic formulation is removed gently, without clogging any pores, and the skin is gently exfoliated leaving the skin and the face very clean and smooth without substantial irritation.

In one exemplary embodiment, the cover 28 is made from a fishnet material sourced from Apex Mills Corporation having the following characteristics:

Material Style Number: DURP50

Material Content: 100% polyester

Material Weight: 0.82+/−15%

Material Wales: 11+/−2

Material Courses: 15+/−3.5

Material Instron Ball Burst: 20 pounds per minute (lbs/min)

Material Thickness: 0.011+/−0.002

In one embodiment, the cover 28 can be cleaned by washing the cover 28 in soap and water for about 20 seconds to remove cosmetic formulation and other debris, and then dried for about 10-20 minutes. The cover 28 may also be formed from or otherwise treated with a suitable material such that it is machine washable and dryable.

One or more surfaces or areas of the cover 28 may also include patterned areas, textures, areas of changing color, etc., to aid in the removal or application of a cosmetic formulation, to indicate an intended area of use for a specific application, and/or to provide an aesthetically pleasing cover. The texture may be created by cutting or defining a pattern in the cover material, by changing the type of material, with flocking, coating, thermoforming, stamping, molding, etc. The texture of the cover 28 can also be manipulated by embossing or debossing using heat, pressure or a combination of these applications.

In some embodiments, one or more surfaces or areas of the cover 28 may also include a combination of materials, such as polyester in the warp direction and nylon in the weft direction. In some embodiments, the same material (ex. nylon) may be used, but the cover 28 may be formed from threads having varying thicknesses or cross sectional shapes. In other embodiments, both the material and cross-sectional shape/thickness of the threads may be varied. The various types and combinations of applied material and cross-sectional shapes/thicknesses of the threads can affect the softness or coarseness of the surface of the cover 28 as applied to the skin. For instance, some types and combinations of applied material and cross-sectional shapes/thicknesses of the threads results in a softer cover 28 for a more delicate cleansing or application effect (such as around the eyes), and other types and combinations result in a coarser cover 28 for exfoliation or deeper cleansing. The material and/or cross-sectional shapes/thicknesses of the threads can also be modified to allow the cover to stretch or have elastic qualities in one or more directions and/or define one or more portions of the cover that are stiff and inflexible. The cover 28 may also have complete directional elasticity/flexibility when made with the same material throughout (isotropic qualities).

The cover 28 may also be made from materials (such as polymers) having shape memory characteristics. Such materials can impart super-elasticity capabilities, air permeability, adaptive responses (actuation such as self-healing, force damping/feedback, stress sensing, thermal sensing, and/or chemical responses), etc. For example, the cover 28 may be made from a self-healing polymer or other restructuring or reconfiguring material such that any damaged or dislocated fibers caused by, for instance, heavy use may be repaired by being exposed to heat (thermal stimulation) under a warm/hot faucet during cleaning. Industrial polymers used for shape memory fibers may include polyurethane, polynorbonene, and pnipam, as examples.

The cover 28 (and optionally the body 24) may also be made from or treated with a suitable material that increases wetting of an aqueous phase of any cosmetic formulation on the surface of the cover 28 (and optionally the body 24). In one embodiment, one or more portions of the cover 28 (and optionally the body 24) may be comprised of at least one hydrophilic or a superhydrophilic material.

The wettability of a region can be determined using various technologies and methodologies including contact angle methods, the Goniometer method, the Whilemy method, or the Sessile drop technique. Wetting is a process by which a liquid interacts with a solid. Wettability (the degree of wetting) is determined by a force balance between adhesive and cohesive force and is often characterized by a contact angle. The contact angle is the angle made by the intersection of the liquid/solid interface and the liquid/air interface. Alternatively, it is the angle between a solid sample's surface and the tangent of a droplet's ovate shape at the edge of the droplet. Contact angle measurements provide a measure of interfacial energies and conveys direct information regarding how hydrophilic or hydrophobic a surface is. For example, superhydrophilic surfaces have contact angles less than about 5°, hydrophilic surfaces have contact angles less than about 90°, hydrophobic surfaces have contact angles greater than about 90°, and superhydrophobic surfaces have contact angles greater than about 150°. (see, e.g., U.S. Publication No. 2013/0131575, entitled "Systems, Devices, and Methods Including Infection-Fighting and Monitoring Shunts," the disclosure of which is hereby incorporated by reference herein in its entirety).

As a specific example, the cover 28 (and optionally the body 24) may be treated with one or more hydrophilic coatings, including polyvinylpyrolidone (PVP), polyurethanes, polyacrylic acid (PAA), polyethylene oxide (PEO), and/or polysaccharides. In the alternative or in addition thereto, the cover 28 (and optionally the body 24) may be treated to increase the surface energy of the cover 28 (and optionally the body 24), such as with a plasma treatment.

In another example, the cover 28 (and optionally the body 24) may be comprised of or otherwise treated with one or more hydrophobic or superhydrophobic coatings such as manganese oxide polystyrene (MnO2/PS) nano-composite, zinc oxide polystyrene (ZnO/PS) nano-composite, precipitated calcium carbonate[3], carbon nano-tube structures, and/or silica nano-coating.

Additional non-limiting examples of materials that affect wettability of a surface include, but are not limited to, amphoteric surfactants, anionic surfactants, cationic surfactants, non-ionic surfactants, and the like.

In the alternative or in addition thereto, the cover 28 (and optionally the body 24) may comprise one or more nanostructures, microstructures, hierarchical structures, and the like that affect wettability of a surface. Non-limiting examples of nanostructures, microstructures, hierarchical structures, and the like include nanopatterned, micropatterned, and the like polymeric coatings. Specific examples include patterned silicon surface, perfluorodecyltriethyoxysilane (PFDTES) coatings, poly (methyl methacrylate) (PMMA) patterned structures, polystyrene (PS) (hydrophobic) patterned structures, and the like.

The above-noted treatments may be applied to any suitable portion of the cover 28 (and optionally the body 24). The cover 28 (and optionally the body 24) may also have one or more portions made from and/or coated with a first type of material and one or more portions made from and/or coated with a second type of material. For instance, the first side 60 of the cover 28 (and optionally the body 24) may have a first material/coating and the second side 62 of the cover 28 (and optionally the body 24) may have a second material/coating. In addition or in the alternative thereto, the first, second, and third corners 66, 68, and 70 of the cover 28 (and optionally the body 24) may be covered with a different material/coating for precise application/removal of a cosmetic application to/from a target area.

It should also be appreciated that the surface properties of the cover 28 (and optionally the body 24) may be defined in any suitable manner. For instance, the cover 28 (and optionally the body 24) itself may be made from a hydrophilic material or hydrophobic material. In the alternative, the cover 28 (and optionally the body 24) may be made from any suitable material, and one or more surfaces of the cover 28 (and optionally the body 24) may be treated with a hydrophilic material or hydrophobic material. Moreover, the cover 28 (and optionally the body 24) may be treated, coated, sprayed, etc., with a suitable material in any suitable manner. In addition, the cover 28 (and optionally the body 24) may be textured or patterned with a coating in a suitable manner. The cover 28 (and optionally the body 24) may also be treated with an antibacterial solution to ensure hygiene with usage.

The chosen material and/or treatment of the cover 28 (and optionally the body 24) may depend on the designated body shape, the size/shape of the hollow interior 60, the body cross-sectional thickness, the intended application, the firmness of the body, etc. For instance, a body having a greater cross-sectional thickness (such as between about 5-10 mm) may include a cover 28 (and optionally the body 24) made from a softer material. A similarly shaped body having a smaller cross-sectional thickness (such as between about 2-4 mm) may include a cover 28 (and optionally the body 24) made from a firmer material. Along the same lines, a thinner cover 28 (and optionally the body 24) may be used with a denser filling, plug, core, or internal webbing (not shown) to help increase the rigidity of the body 24 without adding thickness.

The cover 28 (and optionally the body 24) may also vary in cross-sectional thickness (such as between about 0.1 mm and 10 mm) to provide a more intense exfoliation effect (with a thicker layer) or less intense exfoliation effect (with a thinner layer) area(s) of the body. As a specific example, the cover 28 (and optionally the body 24) may be thinner in the larger areas of the cover 28 (such as the first and second opposing sides 60 and 62), and thicker in the smaller areas of the cover, such as in the corners or more pointed areas. As yet another example, a first side of the cover 28 may have a first cross-sectional thickness and an opposite side of the cover 28 may have a second cross-sectional thickness.

The cover 28 (and optionally the body 24) may also vary in surface roughness/texture, shape, coefficient of friction, etc., in different areas of the body. A lower coefficient of friction on the outer surface of the body may provide a less intense exfoliation effect when cleansing, or a smoother application of certain cosmetic formulations (such as lip gloss), wherein a textured surface may be more suitable for deep cleansing/exfoliation or application of other types of cosmetic formulations. The surface roughness/texture, shape, coefficient of friction, etc., may be created by cutting, etching, or defining a pattern in the cover 28 (and optionally the body 24) during a molding process, with flocking, coating, etc. For example, the cover 28 (and optionally the body 24) may be varied with different materials, thicknesses, textures, patterns, etc., as shown and described in U.S. patent application Ser. No. 15/828,046, which is hereby expressly incorporated by reference herein in its entirety.

It can be appreciated from the foregoing that the cover 28 (and optionally the body 24) can be configured for the beauty tool 20 to be used for various different keratinous treatments and different treatment areas (e.g., face, body, lips, hair, hair/scalp, nails, etc.) while providing desired sensorial effects to the user and without damaging the skin surface or any sensitive areas. With the user having a choice of the body and/or the cover, the beauty tool 20 can produce individual and satisfying sensorial and aesthetic results for the user.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a beauty tool and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to the core may be adapted for use with the cover, and vice versa.

Although certain descriptive terms are used to illustrate or describe certain aspects or benefits of the present invention, they should not be seen as limiting. For instance, although the term "keratinous treatment(s)" is used, it should be appreciated that any or all of the beauty tools described and illustration herein may also be used for other uses not mentioned.

The present disclosure also includes references to directions, such as "upper," "lower," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" (as used with the phrase "beauty tool") should be interpreted broadly to include any cosmetic formulation, beauty product, lotion, lacquer, etc., generally applied to a person's skin, eyes, nails, or other body part.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about," "approximately," etc., mean plus or minus 5% of the stated value.

While illustrative embodiments have been illustrated and described, it will be appreciated that various changes can be made therein without departing from the spirit and scope of the invention.

The embodiments of the invention in which an exclusive property or privilege is claimed are defined as follows:

1. A beauty tool, comprising a cover made from a fishnet material and a hollow body enclosed within the cover, wherein the hollow body includes an opening or valve for a user to adjust an interior pressure of the body with a gas, liquid, or fluid to adjust the firmness, size, or shape of the body for various uses including cleansing, exfoliation, make-up application, or make-up removal, wherein the cover is configured to enclose the body in the various uses in a manner such that the cover substantially and tightly conforms to the shape of the body that allows the selected cleansing, exfoliation, make-up application, or make-up removal result, wherein the cover includes an opening configured to allow removal of the cover from the hollow body, and wherein the cover is made from a material configured for cleansing, exfoliation, and/or massaging a keratinous material without damaging the keratinous material.

2. The beauty tool of claim 1, wherein the fishnet material is polyester, nylon, or any combination thereof.

3. The beauty tool of claim 1, wherein the cover includes at least first and second sides and at least first, second, and third corners.

4. The beauty tool of claim 1, wherein the cover is coated with a first material and a second material different from the first material.

5. The beauty tool of claim 4, wherein the cover includes at least one of a hydrophilic material or a hydrophobic material.

6. The beauty tool of claim 5, wherein the cover includes a hydrophilic material chosen from the group consisting of polyvinylpyrolidone (PVP), polyurethanes, polyacrylic acid (PAA), polyethylene oxide (PEO), polysaccharides, and any combination thereof.

7. The beauty tool of claim 5, wherein the cover includes a hydrophobic material chosen from the group consisting of manganese oxide polystyrene (MnO2/PS) nano-composite, zinc oxide polystyrene (ZnO/PS) nano-composite, precipitated calcium carbonate[3], carbon nano-tube structures, silica nano-coating, and any combination thereof.

8. The beauty tool of claim 4, wherein the cover includes a hydrophilic material and a hydrophobic material.

9. The beauty tool of claim 1, wherein at least a portion of the cover is treated to increase a surface energy of the cover.

10. The beauty tool of claim 1, wherein at least a portion of the cover has a patterned surface to increase wettability.

11. The beauty tool of claim 1, wherein at least one of a material of the cover and a cross-sectional thickness of the body at least partially determines a rigidity of the tool.

12. The beauty tool of claim 1, wherein one or more surfaces or areas of the cover are defined by a first material in a warp direction and a second material in a weft direction.

13. The beauty tool of claim 1, wherein one or more areas of the cover include material threads having at least one of varying thicknesses and cross sectional shapes.

14. The beauty tool of claim 1, wherein one or more areas of the cover is made from a material having shape memory characteristics.

15. The beauty tool of claim 1, wherein one or more areas of the cover is made from a restructuring or reconfiguring material.

16. The beauty tool of claim 15, wherein the restructuring or reconfiguring material is a self-healing polymer.

17. The beauty tool of claim 1, wherein the cover material has a weight (oz/sq yd) of 0.82 plus or minus 15%, wales (width/inch) of 11 plus or minus 2, and courses (length/inch) of 15 plus or minus 3.5.

18. The beauty tool of claim 1, wherein the cover is removable from the hollow body.

* * * * *